US008698023B2

(12) United States Patent
Grünwald

(10) Patent No.: US 8,698,023 B2
(45) Date of Patent: Apr. 15, 2014

(54) ELECTRICAL SWITCH

(75) Inventor: Jan Grünwald, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 287 days.

(21) Appl. No.: 13/187,695

(22) Filed: Jul. 21, 2011

(65) Prior Publication Data

US 2012/0024680 A1 Feb. 2, 2012

(30) Foreign Application Priority Data

Jul. 29, 2010 (DE) ..... 10 2010 033 236

(51) Int. Cl.
*H01H 9/02* (2006.01)

(52) U.S. Cl.
USPC ..... 200/304; 200/303; 335/201; 335/202

(58) Field of Classification Search
None
See application file for complete search history.

(56) References Cited

U.S. PATENT DOCUMENTS

| | | | | |
|---|---|---|---|---|
| 5,241,289 | A * | 8/1993 | Markowski et al. | 335/201 |
| 5,304,761 | A * | 4/1994 | Rosen et al. | 218/157 |
| 6,238,254 | B1 | 5/2001 | De Pourquoy et al. | |
| 6,512,192 | B1 * | 1/2003 | Yee et al. | 218/157 |
| 6,762,389 | B1 * | 7/2004 | Crooks et al. | 218/157 |
| 6,930,577 | B2 * | 8/2005 | Subramanian et al. | 335/202 |
| 7,009,126 | B2 * | 3/2006 | Etscheidt et al. | 200/293 |
| 7,619,902 | B2 * | 11/2009 | Buchbender et al. | 361/833 |
| 7,701,313 | B2 * | 4/2010 | Kim | 335/202 |
| 7,786,831 | B2 * | 8/2010 | Oh | 335/202 |
| 2002/0027489 | A1 * | 3/2002 | Letient | 335/202 |

FOREIGN PATENT DOCUMENTS

| | | |
|---|---|---|
| DE | 4303550 | 8/1993 |
| DE | 29715050 | 10/1997 |
| DE | 102009041034 | 3/2001 |
| DE | 69713853 | 3/2003 |

(Continued)

OTHER PUBLICATIONS

"Switching, protection, communication—the new NZM circuit-breaker series up to 1600 A," http://nzm.moeller.net, pp. 1-24, Others; 2004.

(Continued)

*Primary Examiner* — Renee Luebke
*Assistant Examiner* — Ahmed Saeed
(74) *Attorney, Agent, or Firm* — Harness, Dickey & Pierce, P.L.C.

(57) ABSTRACT

An embodiment of the invention relates to an electrical switch having a basic enclosure with an enclosure top side, an enclosure underside and at least one lateral connection side at which at least one connection contact disposed inside the enclosure of the switch is accessible for the purpose of effecting an electrical connection from outside, and a terminal cover which closes off the connection side laterally at least in sections. It is provided according to at least one embodiment of the invention that an insulating part is clipped onto the basic enclosure on the connection side of the basic enclosure, the insulating part separating the connection contact from the enclosure underside, an enclosure extension which increases the length of the switch being clipped onto the basic enclosure on the connection side of the basic enclosure, a terminal cover being clipped onto the enclosure extension, a gap remaining between the insulating part and the terminal cover when viewed from the enclosure underside, and a separate closure part which seals the gap on the enclosure underside being disposed in the gap.

19 Claims, 12 Drawing Sheets

(56) References Cited

FOREIGN PATENT DOCUMENTS

| | | |
|---|---|---|
| DE | 20318855 | 2/2004 |
| DE | 102004043468 | 3/2006 |
| DE | 102007025372 | 9/2008 |
| DE | 202010012329 | 11/2010 |
| EP | 0 908 915 | 4/1999 |

OTHER PUBLICATIONS

Official German Priority Document DE 10 2010 033 236.4, not yet published.
Office Action for corresponding German patent application No. 102010033236.4 dated Aug. 2, 2011.

* cited by examiner

ELECTRICAL SWITCH

PRIORITY STATEMENT

The present application hereby claims priority under 35 U.S.C. §119 on German patent application number DE 10 2010 033 236.4 filed Jul. 29, 2010, the entire contents of which are hereby incorporated herein by reference.

FIELD

At least one embodiment of the invention generally relates to an electrical switch having a basic enclosure with an enclosure top side, an enclosure underside and at least one lateral connection side at which the at least one connection contact disposed in the interior of the enclosure of the switch is accessible for the purpose of effecting an electrical connection from outside, and a terminal cover which closes off the connection side laterally at least in sections.

BACKGROUND

A switch is sold by the company Moller and is illustrated for example on page 18 of the brochure W1230-7558 GB K. P/DM 04/04 of the company Moller.

SUMMARY

In at least one embodiment of the invention, an electrical switch is disclosed which can be cost-effectively manufactured and easily assembled and installed as well as which can be adapted in a particularly simple manner to different market-specific safety requirements, in particular to different requirements in respect of air gaps and leakage paths.

At least one embodiment of the invention is directed to a switch. Advantageous embodiments of the switch according to the invention are disclosed in dependent claims.

According thereto it is inventively provided in at least one embodiment, that an insulating part is clipped onto the basic enclosure on the connection side of the basic enclosure, the insulating part separating the connection contact from the enclosure underside, an enclosure extension which increases the length of the switch being clipped onto the basic enclosure on the connection side of the basic enclosure, a terminal cover being clipped onto the enclosure extension, a gap remaining between the insulating part and the terminal cover when viewed from the enclosure underside, and a separate closure part which seals the gap on the enclosure underside being disposed in the gap.

A significant advantage of the switch according to at least one embodiment of the invention is to be seen in the fact that it is very flexibly reconfigurable in terms of the embodiment of the lateral connection sides. If particularly high safety standards are to be achieved by way of large air gaps and leakage paths, the enclosure extension is mounted onto the basic enclosure, thus increasing the resulting switch length and enlarging the air gaps and leakage paths. If less stringent market-specific requirements in respect of the length of the air gaps and leakage paths are specified, the provision of the enclosure extension can be dispensed with in certain circumstances and a terminal cover can be mounted directly onto the basic enclosure. The switch is therefore reconfigurable with minimal effort owing to its inventive modular structure comprising enclosure extension, insulating part, terminal cover and separate closure part, and can be tailored to market-specific requirements.

A further significant advantage of the switch according to at least one embodiment of the invention is that a separate closure part is provided by which a gap on the enclosure underside between the terminal cover and the insulating part is sealed. By virtue of the provision of such a separate closure part it can be achieved that the insulating parts which are clipped onto the basic enclosure in order to isolate the connection contacts electrically from the enclosure underside can be implemented as standard parts which can be used irrespective of whether an enclosure extension is used or not. If no enclosure extension is used, the insulating parts can be used without an additional separate closure part in each case; if, on the other hand, one or more enclosure extensions are additionally clipped onto the basic enclosure, the gap forming on the enclosure underside is closed in each case by way of a separate closure part. The inventively provided provisioning of separate closure parts which cooperatively interact with the insulating parts also increases the modularity of the switch according to the invention and its adaptability to different market-specific requirements.

In an example embodiment of the switch, it is provided that the closure part and the insulating part are snap-fitted to one another by way of a snap-action connection. Such a snap-action connection between the closure part and the insulating part results in a further considerable improvement in the assembly possibilities of the closure part. Thus, for example, the closure part can be joined to the insulating part before the insulating part is clipped onto the basic enclosure; alternatively it is possible to attach the closure part to the insulating part only at a later time. In this case the closure part can be attached to the switch for example by being pushed onto the associated insulating part and snap-fitted with the latter.

The closure part preferably has at least one engagement hook which can be interlocked with at least one recess in the associated insulating part.

Particularly preferably the snap-action connection is embodied in such a way that after a closure part has been joined to an associated insulating part it can no longer be nondestructively disassembled and a permanently fixed connection is established.

Preferably the enclosure extension has at least two parallel-running carrier elements which are suitable for carrying a separate closure part.

Particularly preferably the closure part and the insulating part each have, when viewed in cross-section, a wide section and an adjacent narrow section. In this case the wide and narrow sections of the closure part and of the insulating part are preferably embodied in such a way that after the closure part has been snap-fitted to the insulating part the wide sections of insulating part and closure part as well as the narrow sections of closure part and insulating part are in each case aligned with one another.

With regard to the relative arrangement between closure part and enclosure extension it is deemed advantageous if the narrow section of the insulating part terminates the enclosure underside and the wide section overlies the two parallel-running carrier elements of the enclosure extension. In such an embodiment the closure part can be particularly easily introduced by being pushed onto the enclosure extension.

It is deemed particularly advantageous if the already mentioned carrier elements have a dual function. For example, the carrier elements of the enclosure extension each form a gas-conducting channel which is connected to an associated gas-conducting channel in the basic enclosure of the switch.

It is furthermore deemed advantageous if the terminal cover does not alter the resulting enclosure length, so that the resulting overall length of the electrical switch is determined solely by the length of the basic enclosure and the attached enclosure extension(s), if any. Accordingly it is deemed advantageous if the terminal cover can be mounted from the enclosure top side by being pushed onto the enclosure extension in parallel with the connection side, and if the terminal cover and the enclosure extension are embodied in such a way that the terminal cover leaves the enclosure length resulting due to the enclosure extension(s) and the basic enclosure unchanged. The enclosure length is for example measured along an enclosure edge which stands vertically with respect to the connection side.

Particularly preferably the enclosure extension has at least one guide element which extends from the enclosure top side in the direction of the enclosure underside and guides and/or retains the terminal cover while it is being pushed on.

It is also deemed advantageous if the insulating part has a lead-through conduit which extends from the enclosure underside through the insulating part in the direction of the enclosure top side. In such an embodiment a connection or joining to internal connection contacts of the switch can be made possible by an electrical terminal lead being passed through from the enclosure underside into the basic enclosure.

Instead of a single extension, the switch can also have a plurality of enclosure extensions, for example if a plurality of connection sides having externally accessible connection contacts are present and if there too higher requirements in respect of air gaps and leakage paths are to be fulfilled. In this case the overall length of the switch is preferably yielded by the sum of the length of the basic enclosure and of the lengths of the enclosure extensions used.

BRIEF DESCRIPTION OF THE DRAWINGS

The invention is explained in more detail below with reference to example embodiments and the attached drawings, in which by way of example.

Figure 1:
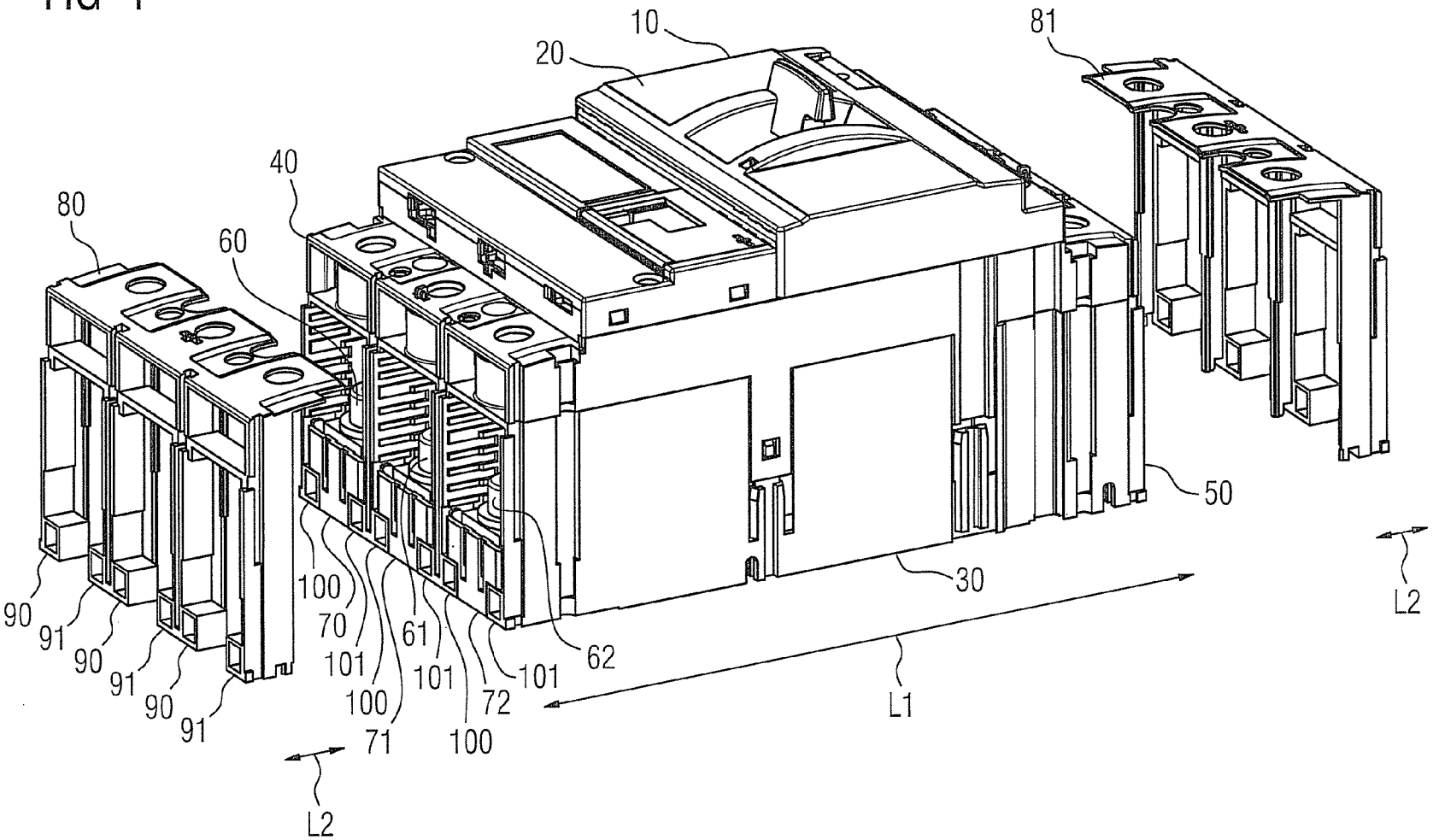
FIG. 1 shows an example embodiment of a switch according to the invention having a basic enclosure and an enclosure extension which can be clipped onto the basic enclosure.

For the sake of clarity of illustration the same reference signs are used consistently in the figures for identical or like components.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows an example embodiment of an electrical switch. A basic enclosure 10 of the switch has an enclosure top side 20, an enclosure underside 30 and two lateral connection sides 40 and 50 which are disposed opposite each other and in each case make electrical terminals of the switch that are located inside the enclosure accessible from outside. The two connection sides 40 and 50 extend vertically with respect to the enclosure top side 20 as well as vertically with respect to the enclosure underside 30.

Also apparent in FIG. 1 are three connection contacts 60, 61 and 62 which are disposed in the interior of the basic enclosure 10 and are accessible from the connection side 40 since the connection side 40 is open.

FIG. 1 additionally shows three insulating parts 70, 71 and 72 which consist of an electrically insulating material and are inserted from the connection side 40 of the basic enclosure 10 in such a way that they are in each case located between an associated connection contact 60, 61 and 62 and the enclosure underside 30 and consequently increase the air gap and leakage path of the respective connection contact 60, 61 and 62 toward the enclosure underside 30. The insulating parts 70, 71 and 72 are embodied in such a way that after being inserted they do not project from the outer contour of the basic enclosure 10 and preferably terminate aligned flush with the connection side 40.

Also apparent in FIG. 1 is an enclosure extension 80 which can be clipped onto the basic enclosure 10 from the enclosure top side 20. The enclosure extension 80 extends vertically with respect to the connection side 40 and consequently parallel to the enclosure top side 20 or, as the case may be, parallel to the enclosure underside 30.

It can be seen that after being clipped onto the basic enclosure 10 the enclosure extension 80 will increase the length L of the switch by the length L2 of the enclosure extension 80. If an enclosure extension 81 corresponding to the enclosure extension 80 is mounted on the connection side 50, i.e. if two enclosure extensions are used, a total enclosure length L of the switch is obtained according to $$L=L1+2*L2.$$

It can also be seen in FIG. 1 that for the purpose of accommodating three separate closure parts (not shown in FIG. 1) the enclosure extension 80 has three carrier element pairs each having two parallel-running carrier elements 90 and 91. In this case each carrier element pair 90/91 serves to accommodate an associated separate closure part.

In the example embodiment according to FIG. 1 the carrier elements 90 and 91 are in each case embodied as gas-conducting channels which cooperatively interact with gas-conducting channels 100 and 101 of the basic enclosure 10 and are aligned flush therewith. The gas-conducting channels 100, 101 and 90 and 91 serve to discharge the hot gases occurring when electric current is shut off out of the basic enclosure 10 to the outside.

Figure 2:
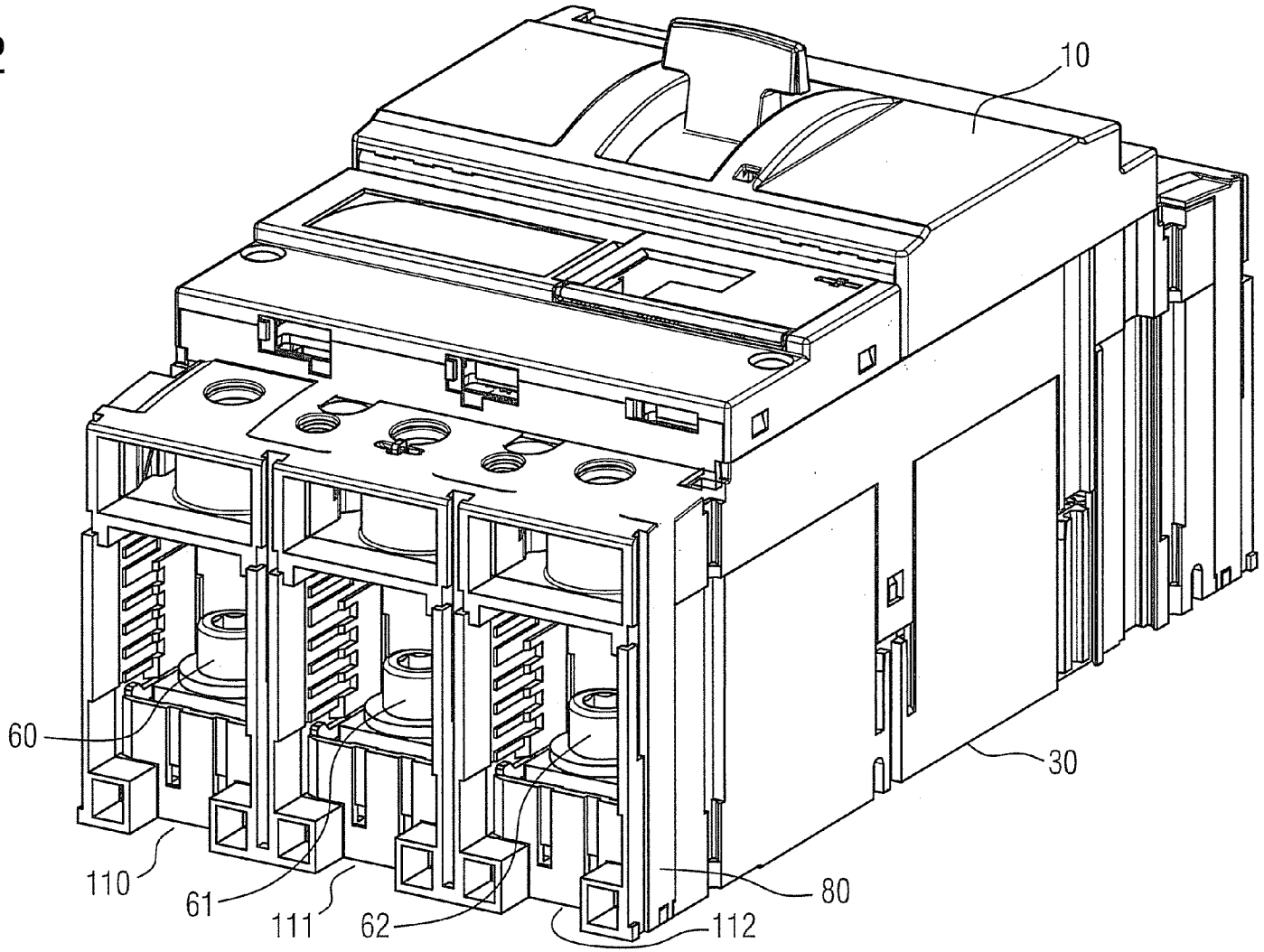
FIG. 2 shows the basic enclosure according to FIG. 1 after the enclosure extension has been clipped on, FIG. 3 shows a terminal cover as well as separate closure parts which can be snapped onto insulating parts contained in the basic enclosure.

FIG. 2 shows the basic enclosure 10 after the enclosure extension 80 has been pushed onto the basic enclosure 10. It can be seen that, when viewed from the enclosure underside 30, there remains for each connection contact 60, 61 and 62 in each case a gap 110, 111 and 112 through which the respective connection contact would be accessible from the enclosure underside 30 provided it is not closed off.

Figure 3:
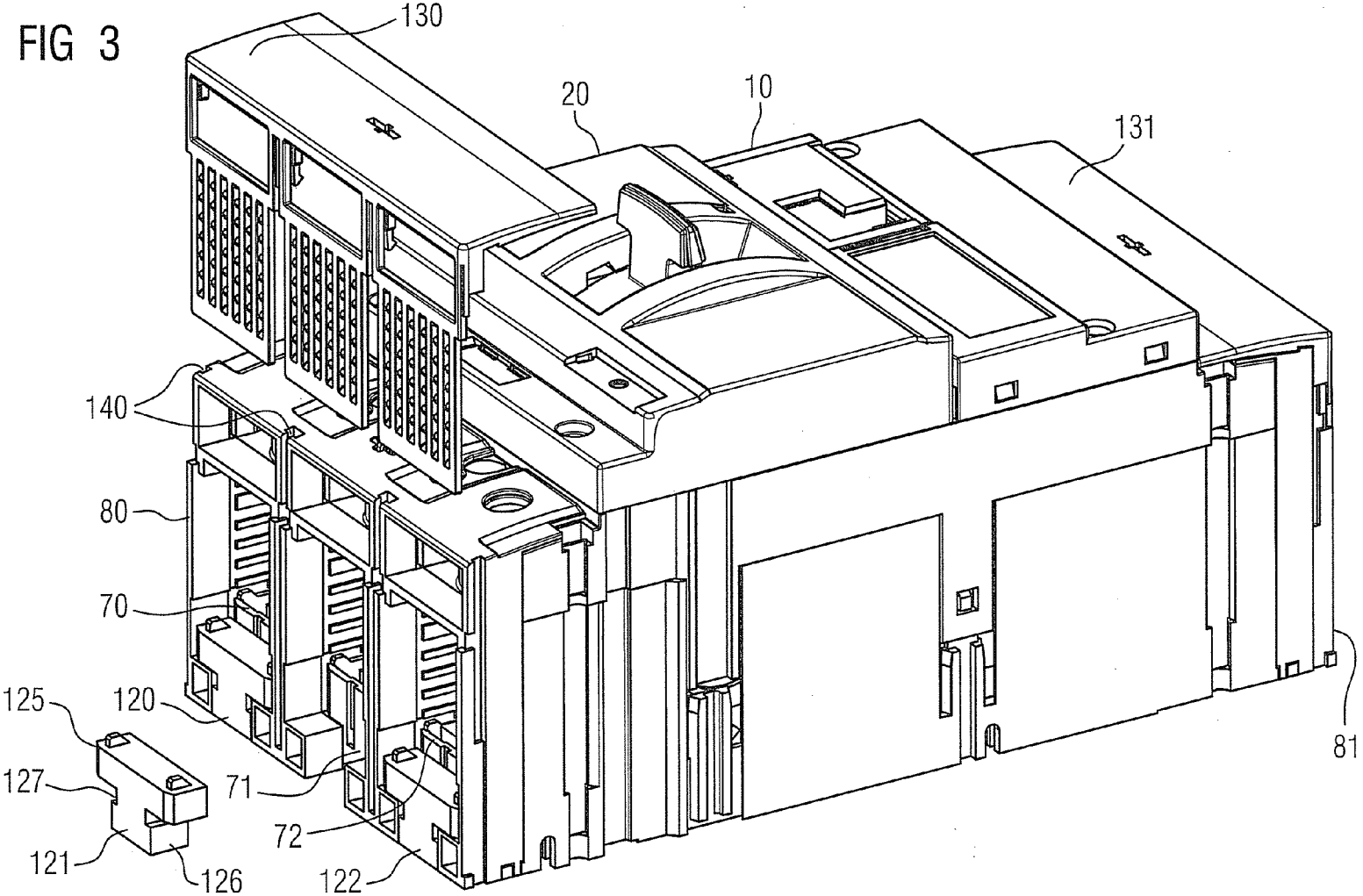

FIG. 3 shows the basic enclosure 10 with the enclosure extension 80 after a separate closure part 120 and 122 has been clipped onto the insulating parts 70 and 72 respectively. In the illustration according to FIG. 3, a separate closure part has not yet been clipped onto the middle insulating part 71; said closure part is shown as a separate component and is identified by the reference sign 121.

It can be seen that the closure part 121 has an upper wide section 125 and a lower section 126 that is narrower by comparison. The wide section 125 is separated from the narrow section 126 by way of a groove 127. The wide section 125 is intended to overlie the carrier element pair 90/91 of the enclosure extension 80; the narrow section 126 is intended to close off the lower gap on the enclosure underside 30.

Also depicted in FIG. 3 are two terminal covers 130 and 131 which can be pushed onto the respective enclosure extension 80 and 81 from the enclosure top side 20 in order to cover the connection contacts at the side and realize finger-proof protection. The terminal covers 130 and 131 are embodied in such a way that they do not increase the resulting enclosure length $$L=L1+2*L2 \qquad \text{(cf. FIG. 1)}$$

and consequently leave the resulting enclosure contour unchanged. In order to achieve this, the enclosure extensions 80 and 81 each have guide elements 140 in the form of grooves which guide and retain the respective terminal cover 130 and 131 during their insertion.

Figure 4:
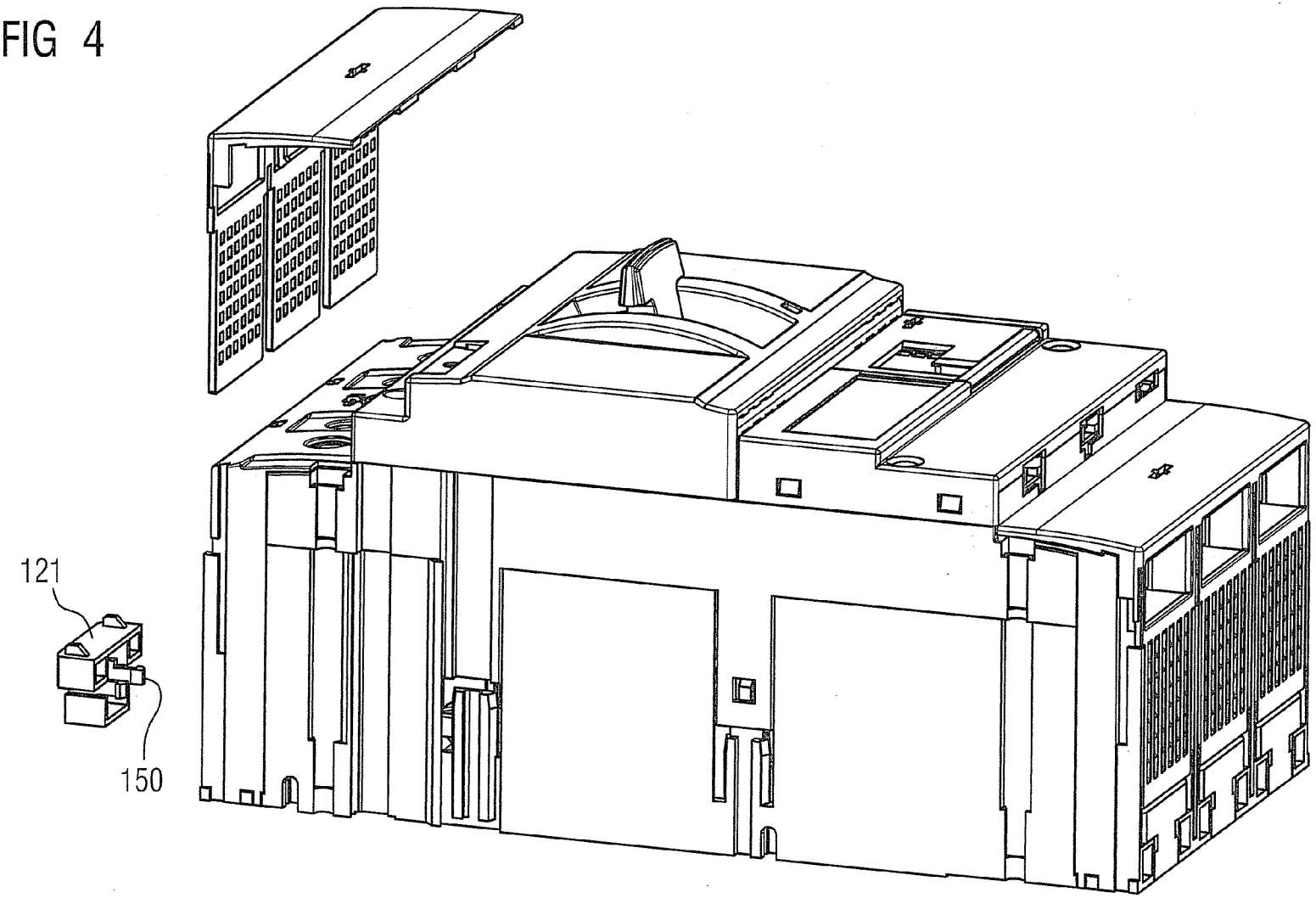
FIG. 4 shows the basic enclosure with the enclosure extension, a separate closure part and the terminal cover in a different view.

FIG. 4 shows the arrangement according to FIG. 3 in a different view. It can be seen that the separate closure part 121 is equipped with engagement hooks 150 which cooperatively interact with associated recesses in the insulating part 71 (cf. FIG. 3) and allow the separate closure part 121 to snap into place on the insulating part 71.

Figure 5:
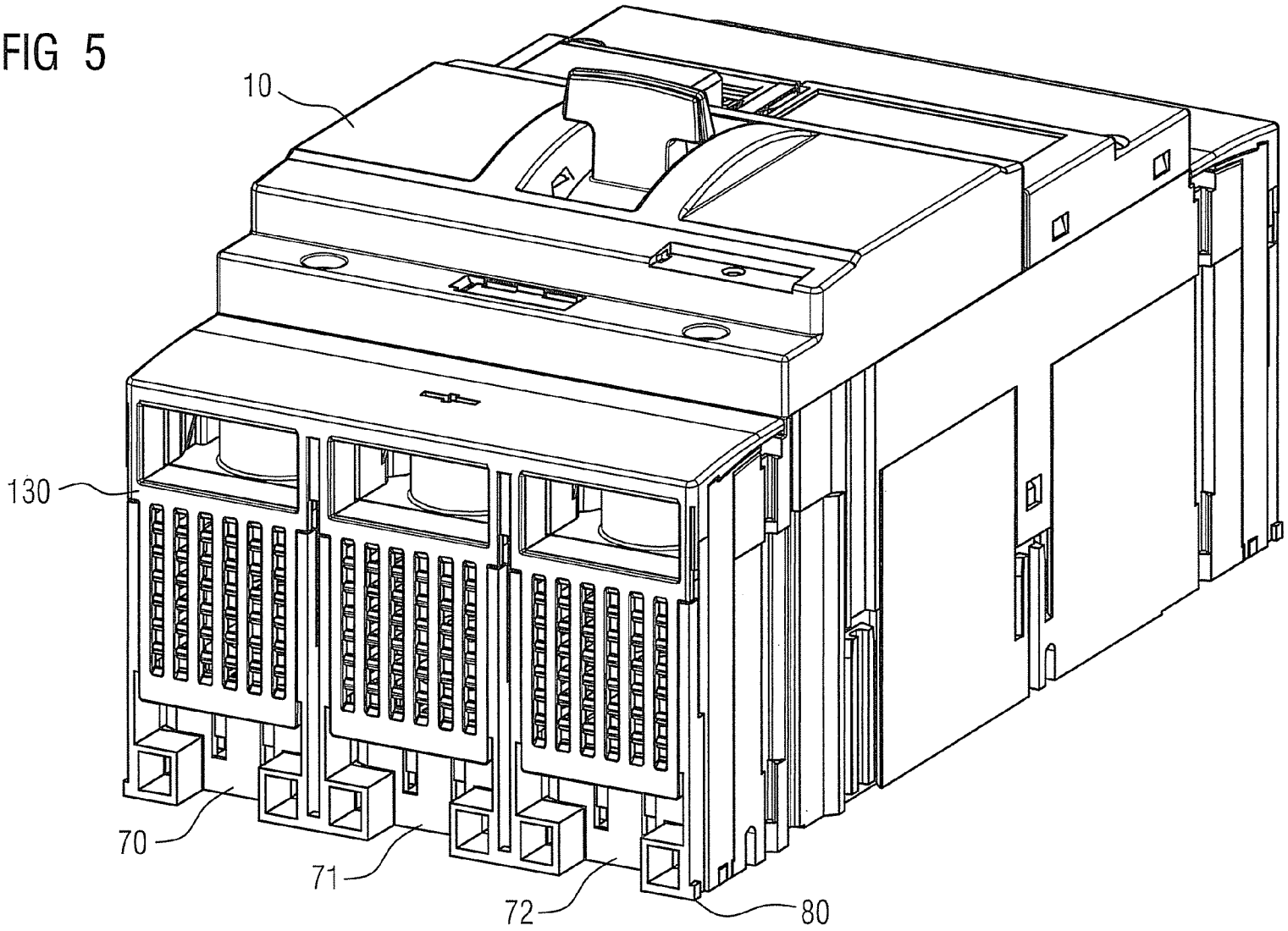
FIG. 5 shows the basic enclosure according to FIG. 1 after the terminal cover has been clipped on, FIG. 6 shows the arrangement according to FIG. 5 after two closure parts have been clipped on, FIG. 7 shows the arrangement according to FIG. 6 in an oblique view from below.

FIG. 5 shows the basic enclosure 10, the enclosure extension 80 and the terminal cover 130 before the separate closure parts 120, 121 and 122 (cf. FIG. 3) have been clipped on. The terminal cover 130 can be dimensioned for example such that even after the terminal cover 130 has been clipped on the separate closure parts can be mounted onto the respective associated insulating parts 70, 71 and 72 and snapped in place with the latter; such an embodiment is not mandatory, however. It can instead be provided that the snap-on closure parts 120, 121 and 122 must be mounted before the terminal cover 130 in order for example to support the terminal cover 130.

Figure 6:
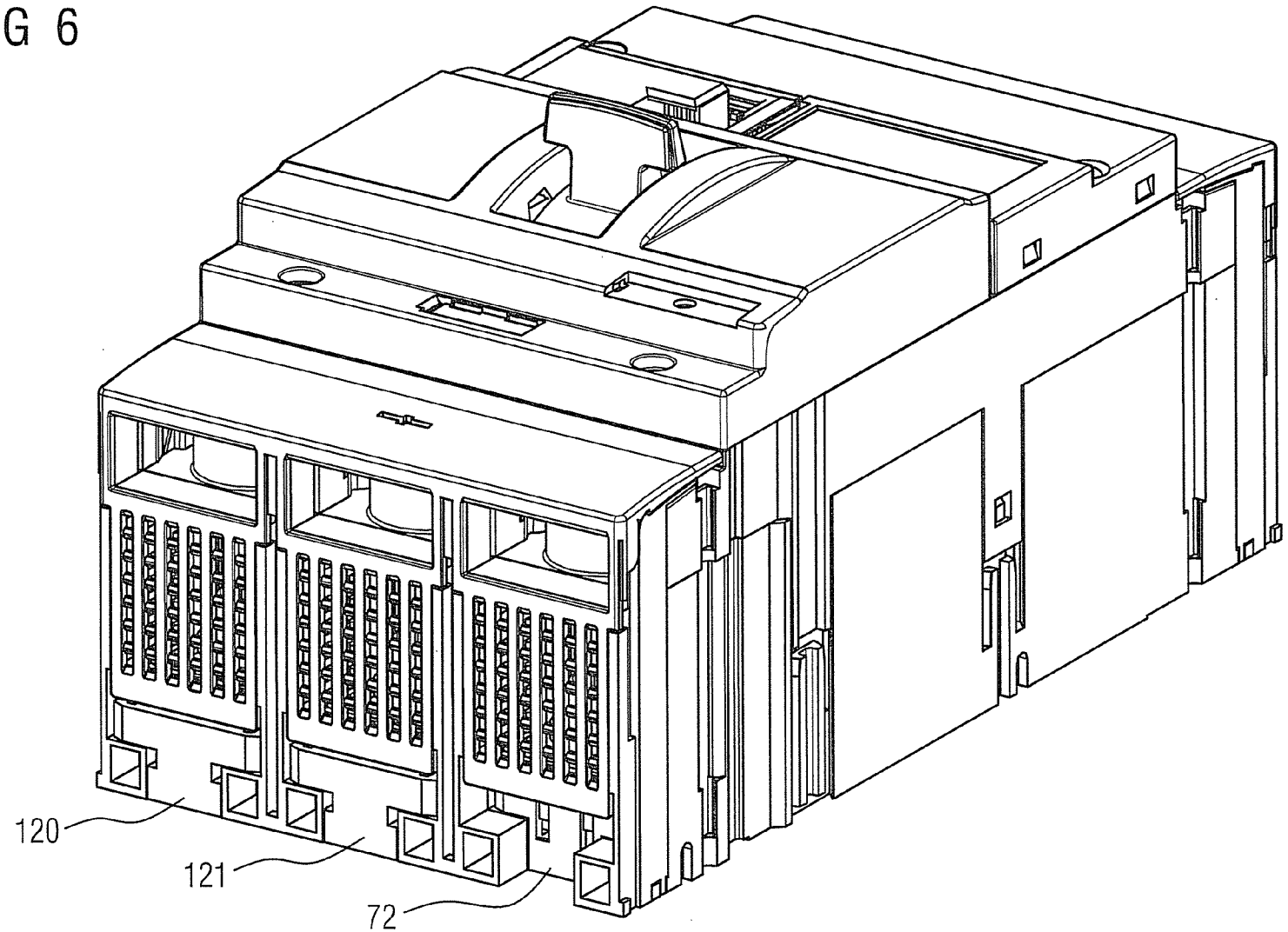

FIG. 6 shows the arrangement according to FIG. 5 after the separate closure parts 120 and 121 have been clipped onto the associated insulating parts. In the illustration according to FIG. 5 the insulating part 72 has not yet been closed off by way of its associated closure part.

Figure 7:
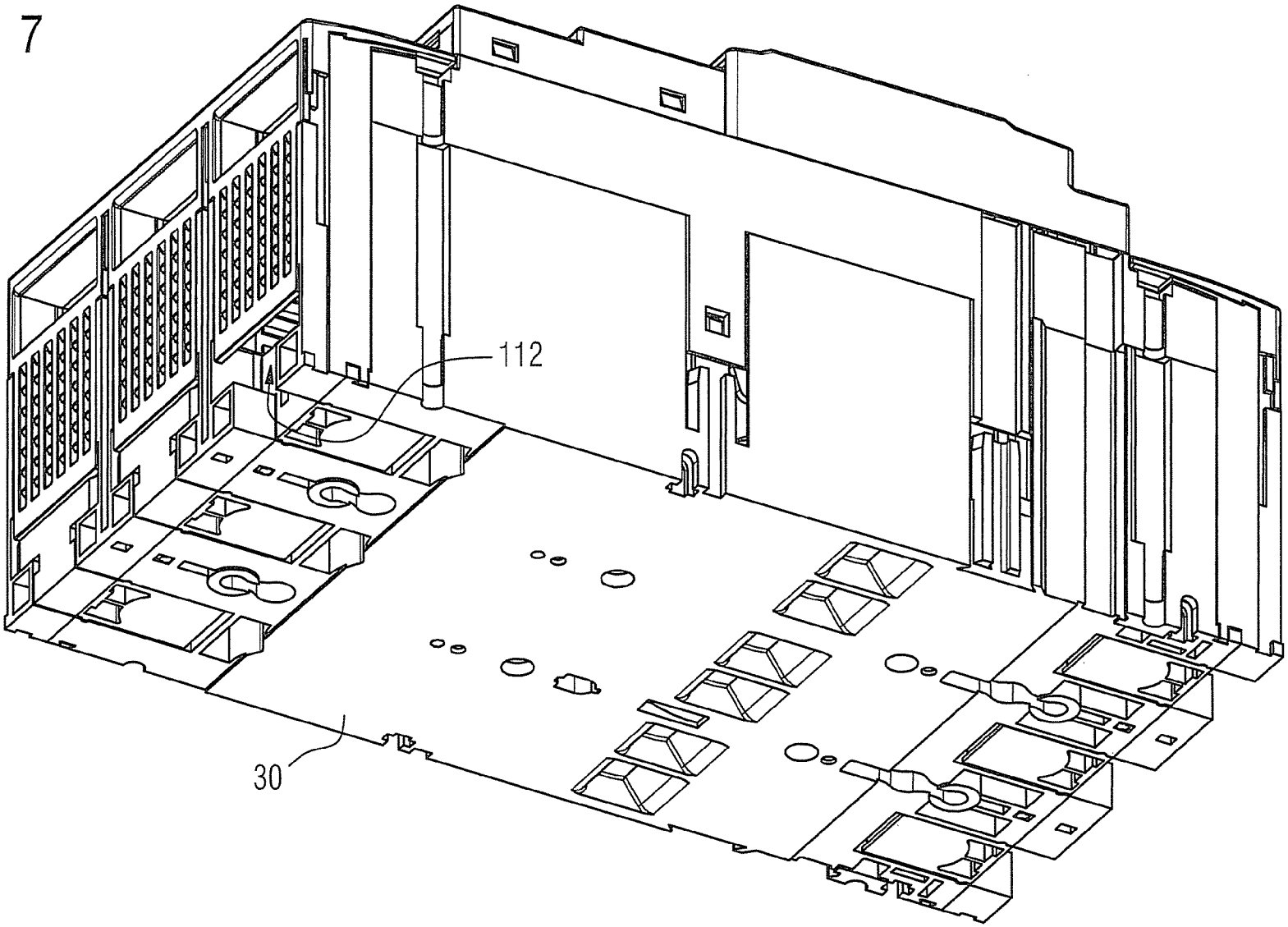

FIG. 7 shows the arrangement according to FIG. 6 in a view from below. It can be seen that due to the absence of the separate closure part 122 on the enclosure underside 30 there remains the gap 112 through which it would be possible to access the electrical connection contact 62 (cf. FIG. 1) of the switch. Said gap 112 is sealed by way of the separate closure part 122 as soon as the latter has been clipped onto the associated insulating part 72 (cf. FIG. 1).

Figure 8:
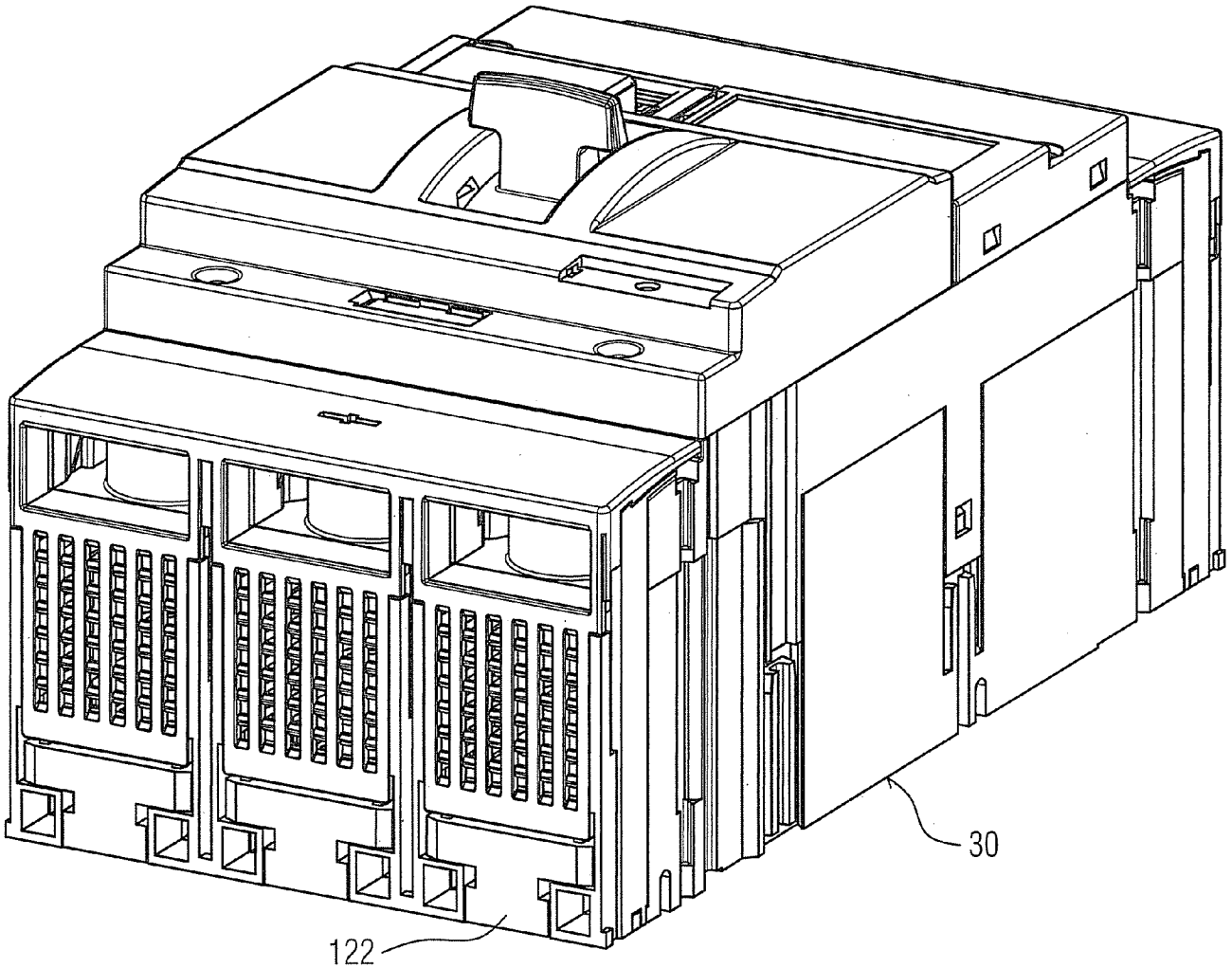
FIG. 8 shows the switch enclosure after three closure parts in total as well as the terminal cover have been clipped on, FIG. 9 shows a second example embodiment of a switch according to the invention in which the terminal cover is breached in sections in order to allow a lateral connection of a terminal lead.

FIG. 8 shows the arrangement according to FIGS. 6 and 7 after the separate closure part 122 has been clipped on and the gap on the enclosure underside 30 has been sealed.

Figure 9:
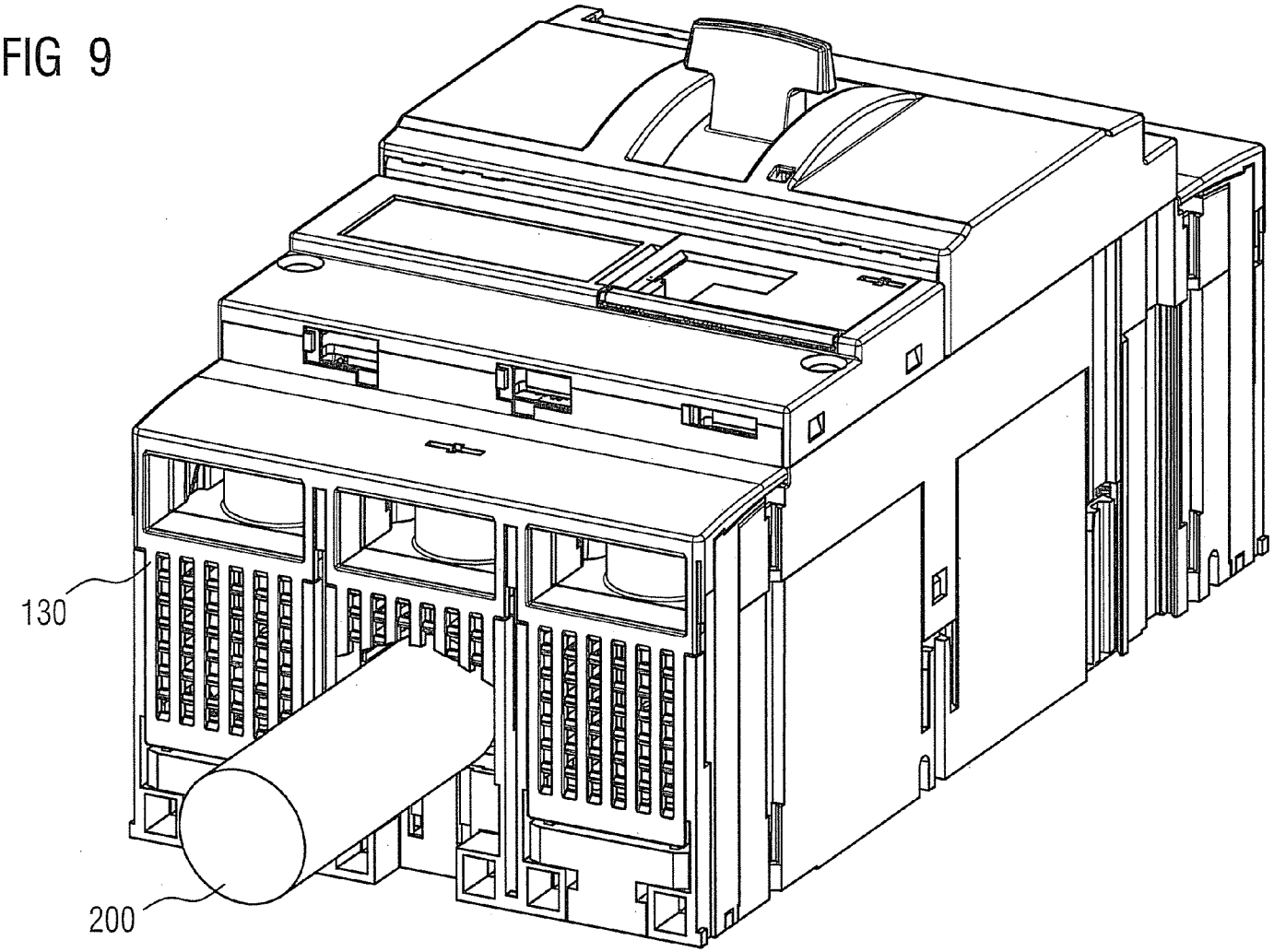

In the illustration according to FIG. 9 the middle connection contact 61 (cf. FIG. 1) of the switch is electrically contacted by way of a terminal lead 200. The terminal cover 130 has been breached accordingly in order to enable the terminal lead 200 to be connected.

Figure 10:
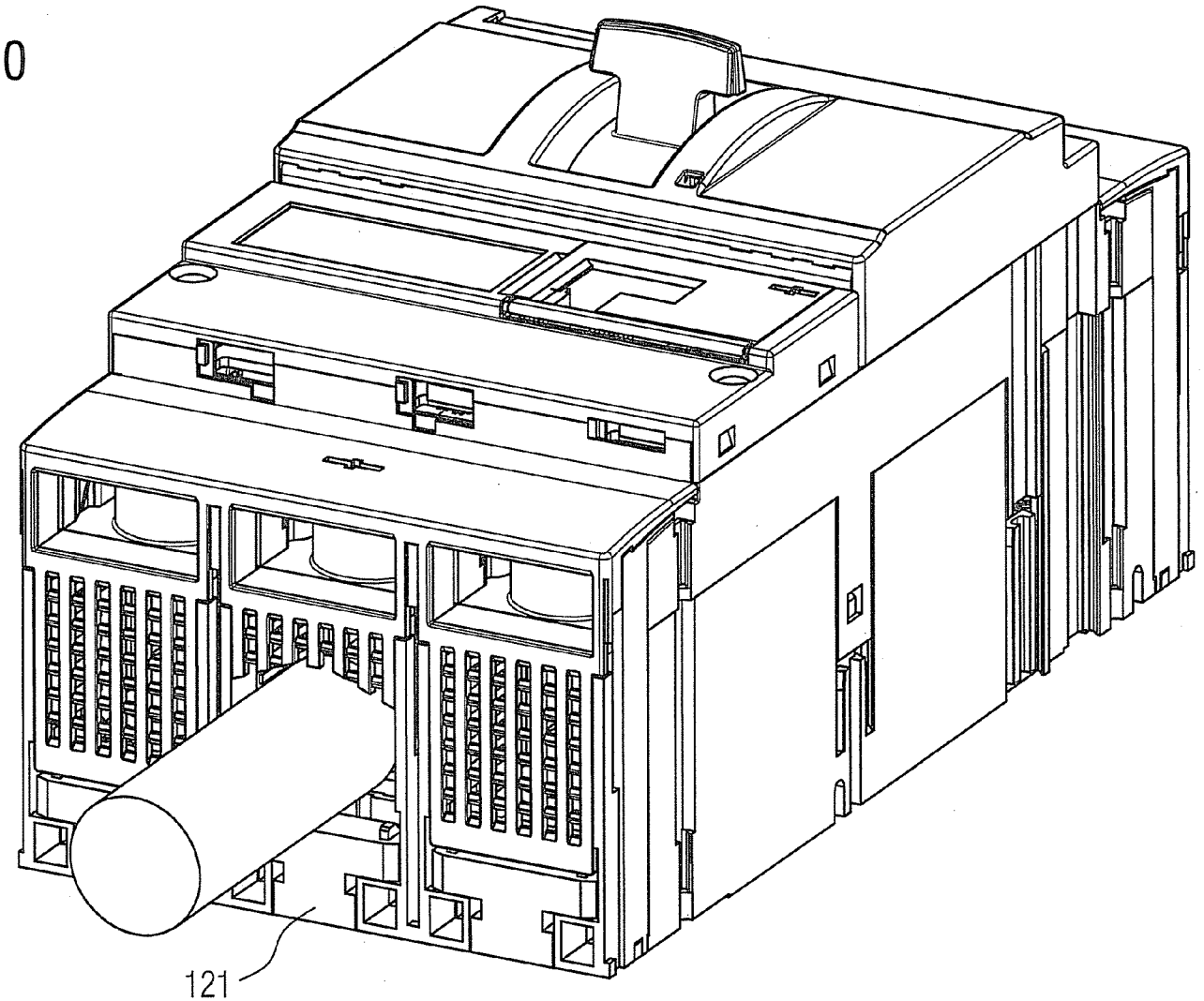
FIG. 10 shows the arrangement according to FIG. 9 after a gap area under the electrical terminal lead has been sealed with a separate closure part.

FIG. 10 shows the arrangement according to FIG. 9 after the associated separate closure part 121 has been mounted onto the middle insulating part. Accessing the electrical connection contact 61 (cf. FIG. 1) from the enclosure underside 30 is thereby prevented and finger-proof protection achieved.

Figure 11:
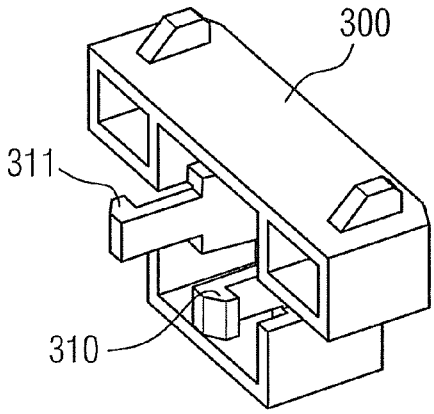
FIG. 11 shows an example embodiment of a separate snap-on closure part with engagement hooks.

FIG. 11 shows an example embodiment of a separate closure part 300 which can be used as a closure part 120, 121 and 122 according to FIG. 3. It can be seen that the closure part 300 has two engagement hooks 310 and 311 by which the closure part can be snap-fitted on an associated insulating part. The embodiment of the engagement hooks 310 and 311 is preferably chosen such that a closure part 300 snap-fitted onto an insulating part can no longer be nondestructively separated from the latter and forms a fixed permanent unit therewith.

Figure 12:
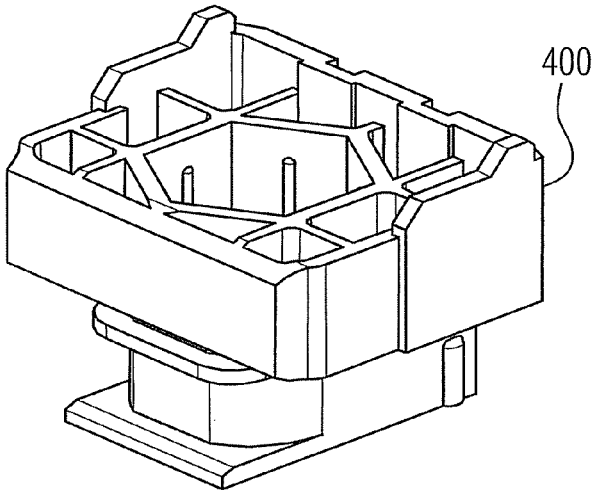
FIG. 12 shows an example embodiment of an insulating part.
Figure 13:
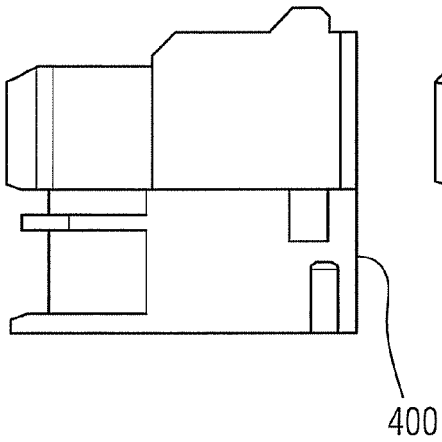
FIG. 13 shows the insulating part according to FIG. 12 in a side view.

FIG. 12 shows an example embodiment of an insulating part 400 which can be used as an insulating part 70, 71 or 72 according to FIG. 1. FIG. 13 shows the insulating part 400 in a side view.

Figure 14:
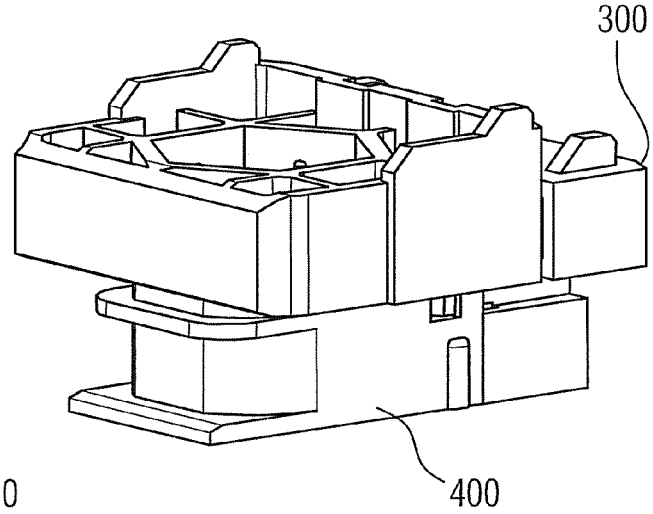
FIG. 14 shows the insulating part according to FIGS. 12 and 13 after a separate closure part has been snapped on, and FIG. 15 shows further example embodiments of insulating parts.

In FIG. 14 it is shown by way of example how the resulting arrangement consisting of separate closure part 300 according to FIG. 11 and insulating part 400 according to FIG. 12 or 13 appears in a three-dimensional view. The closure part 300 is snap-fitted by way of its engagement hooks permanently on the insulating part 400 and together with the latter forms a unit that is no longer nondestructively separable.

Figure 15:
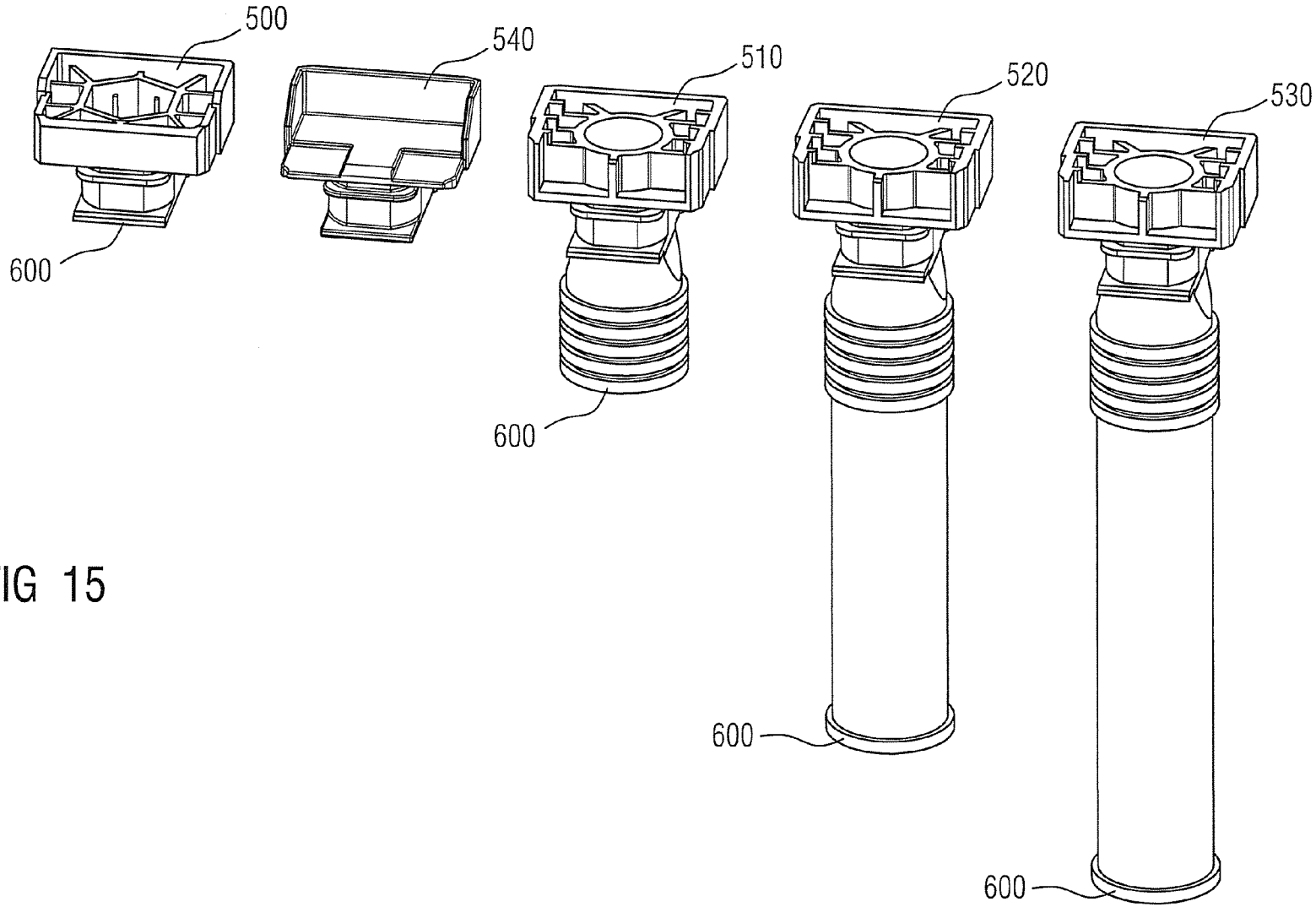

FIG. 15 shows by way of example further embodiments of the insulating parts 70, 71 and 72 according to FIG. 1. It can be seen that the insulating parts labeled with the reference signs 500, 510, 520 and 530 each have a lead-through conduit 600 which enables an electrical terminal lead to be passed through and thus allows an electrical contacting of the connection contacts 60, 61 and 62 (cf. FIG. 1) to be established from the enclosure underside 30.

The insulating part 540 has no corresponding lead-through conduit, such that when said insulating part is used the electrical contacting must be established from the side with the aid of a separate terminal lead, as shown by way of example in FIGS. 9 and 10.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

List of Reference Signs

10 Basic enclosure
20 Enclosure top side
30 Enclosure underside
40 Connection side
50 Connection side
60 Connection contact
61 Connection contact
62 Connection contact
70 Insulating part
71 Insulating part
72 Insulating part
80 Enclosure extension
90 Carrier element
91 Carrier element
100 Gas-conducting channel
101 Gas-conducting channel
110 Gap
111 Gap
112 Gap
120 Closure part
121 Closure part

122 Closure part
125 Wide section
126 Narrow section
127 Groove
130 Terminal cover
140 Guide element
150 Engagement hook
200 Terminal lead
300 Closure part
310 Engagement hook
311 Engagement hook
400 Insulating part
500 Insulating part
510 Insulating part
520 Insulating part
600 Lead-through conduit
L1 Length
L2 Length

What is claimed is:

1. An electrical switch, comprising:

a basic enclosure with an enclosure top side, an enclosure underside and at least one lateral connection side at which at least one connection contact disposed inside the enclosure of the switch is accessible for the purpose of effecting an electrical connection from outside;

a terminal cover which closes off the connection side laterally at least in sections;

an insulating part, clipped onto the basic enclosure on the connection side of the basic enclosure, the insulating part separating the at least one connection contact from the enclosure underside;

an enclosure extension, which increases the length of the switch, clipped onto the basic enclosure on the connection side of the basic enclosure, the terminal cover being clipped onto the enclosure extension and a gap remaining between the insulating part and the terminal cover when viewed from the enclosure underside; and a separate closure part, to seal the gap on the enclosure underside disposed in the gap.

2. The electrical switch as claimed in claim 1, wherein the closure part and the insulating part are snap-fitted to one another by way of a snap-action connection.

3. The electrical switch as claimed in claim 2, wherein the closure part includes at least one engagement hook and the insulating part has at least one recess for interlocking with the engagement hook.

4. The electrical switch as claimed in claim 1, wherein, when viewed in cross-section, the closure part and the insulating part each include a wide section and a narrow section.

5. The electrical switch as claimed in claim 1, wherein the enclosure extension includes two parallel-running carrier elements for accommodating the closure part.

6. The electrical switch as claimed in claim 1, wherein the narrow section of the insulating part terminates the enclosure underside and the wide section overlies the two parallel-running carrier elements of the enclosure extension.

7. The electrical switch as claimed in claim 1, wherein the two parallel-running carrier elements of the enclosure extension form gas-conducting channels which are connected to gas-conducting channels of the basic enclosure.

8. The electrical switch as claimed in claim 1, wherein the terminal cover is mountable on the enclosure extension from the enclosure top side by being pushed onto the enclosure extension in parallel with the connection side, and the terminal cover and the enclosure extension are embodied in such a way that the terminal cover leaves the enclosure length resulting due to the enclosure extension and the basic enclosure unchanged.

9. The electrical switch as claimed in claim 8, wherein the enclosure extension includes at least one guide element which extends from the enclosure top side in the direction of the enclosure underside and at least one of guides and holds the terminal cover while it is being pushed on.

10. The electrical switch as claimed in claim 1, wherein the insulating part includes a lead-through conduit which extends through the insulating part from the enclosure underside in the direction of the enclosure top side and enables an electrical terminal lead to be routed through from the enclosure underside into the basic enclosure.

11. The electrical switch as claimed in claim 2, wherein, when viewed in cross-section, the closure part and the insulating part each include a wide section and a narrow section.

12. The electrical switch as claimed in claim 2, wherein the enclosure extension includes two parallel-running carrier elements for accommodating the closure part.

13. The electrical switch as claimed in claim 2, wherein the narrow section of the insulating part terminates the enclosure underside and the wide section overlies the two parallel-running carrier elements of the enclosure extension.

14. The electrical switch as claimed in claim 2, wherein the two parallel-running carrier elements of the enclosure extension form gas-conducting channels which are connected to gas-conducting channels of the basic enclosure.

15. The electrical switch as claimed in claim 2, wherein the terminal cover is mountable on the enclosure extension from the enclosure top side by being pushed onto the enclosure extension in parallel with the connection side, and the terminal cover and the enclosure extension are embodied in such a way that the terminal cover leaves the enclosure length resulting due to the enclosure extension and the basic enclosure unchanged.

16. The electrical switch as claimed in claim 15, wherein the enclosure extension includes at least one guide element which extends from the enclosure top side in the direction of the enclosure underside and at least one of guides and holds the terminal cover while it is being pushed on.

17. The electrical switch as claimed in claim 2, wherein the insulating part includes a lead-through conduit which extends through the insulating part from the enclosure underside in the direction of the enclosure top side and enables an electrical terminal lead to be routed through from the enclosure underside into the basic enclosure.

18. The electrical switch as claimed in claim 1, wherein the terminal cover covers the at least one connection contact in a direction normal to enclosure topside and the enclosure underside.

19. The electrical switch as claimed in claim 1, wherein the enclosure top side includes a switch operating handle.

* * * * *